US007938163B2

(12) United States Patent
Caruso

(10) Patent No.: US 7,938,163 B2
(45) Date of Patent: May 10, 2011

(54) SPLINE APPARATUS

(76) Inventor: Michael Caruso, Wallingford, CT (US)

( * ) Notice: Subject to any disclaimer, the term of this patent is extended or adjusted under 35 U.S.C. 154(b) by 578 days.

(21) Appl. No.: 11/971,186

(22) Filed: Jan. 8, 2008

(65) Prior Publication Data

US 2008/0099167 A1 May 1, 2008

Related U.S. Application Data

(63) Continuation-in-part of application No. 11/904,140, filed on Sep. 26, 2007, now abandoned.

(60) Provisional application No. 60/827,312, filed on Sep. 28, 2006, provisional application No. 60/881,720, filed on Jan. 22, 2007.

(51) Int. Cl.
*E06B 3/00* (2006.01)

(52) U.S. Cl. ..... 160/392; 160/369

(58) Field of Classification Search ..... 160/369, 160/371, 379, 392, 395, 201; 52/202, 222, 52/63

See application file for complete search history.

(56) References Cited

U.S. PATENT DOCUMENTS 2,835,325 A * 5/1958 Gilbert et al. ..... 160/369
2,837,153 A * 6/1958 Brown et al. ..... 160/371
3,143,165 A 8/1964 Lewis
3,222,841 A * 12/1965 Lipof ..... 52/482
3,382,639 A * 5/1968 Smith et al. ..... 52/844
4,057,941 A * 11/1977 Schwartz ..... 52/63
4,084,360 A * 4/1978 Reckson ..... 52/63
4,189,880 A 2/1980 Ballin
4,232,310 A * 11/1980 Wilson ..... 340/550
4,233,790 A 11/1980 Meadows
4,261,144 A * 4/1981 Rizzo ..... 52/63
4,333,284 A 6/1982 Meadows
4,410,027 A 10/1983 Lucous
4,662,038 A 5/1987 Walker
4,690,192 A * 9/1987 Stilling ..... 160/57
5,076,033 A * 12/1991 Patsy, Jr. ..... 52/222
5,143,138 A 9/1992 Zwart
5,545,488 A * 8/1996 Burke ..... 428/586
5,613,544 A 3/1997 Schaefer
5,737,885 A * 4/1998 Stoyke ..... 52/202
5,803,145 A * 9/1998 Lamb ..... 160/90
5,887,391 A * 3/1999 Shoup ..... 52/202
6,338,226 B1 * 1/2002 Gauthier et al. ..... 52/63
7,302,986 B2 * 12/2007 Flack et al. ..... 160/89

* cited by examiner

*Primary Examiner* — David Purol
(74) *Attorney, Agent, or Firm* — Raymond A. Nuzzo

(57) ABSTRACT

A spline apparatus is provided which includes a spline section and a spline channel cover section. The spline apparatus includes an intermediate section that is intermediate and joined to the spline section and a spline channel cover section. A frame member is also provided that can be used with the aforesaid spline apparatus. A center divider is also provided which can be used with the aforesaid frame member and spline apparatus to form a complete main frame assembly that can retain a screen insert and/or glazed insert. An "R" channel member is also provided for use with the aforesaid frame member.

4 Claims, 21 Drawing Sheets

SPLINE APPARATUS

CROSS-REFERENCE TO RELATED APPLICATIONS

The application is a continuation-in-part application of application Ser. No. 11/904,140, filed Sep. 26, 2007 now abandoned, which claims the benefit of U.S. Provisional Application No. 60/827,312, filed Sep. 28, 2006. Application Ser. No. 11/904,140 is hereby incorporated by reference.

This application claims the benefit of U.S. Provisional Application No. 60/881,720, filed Jan. 22, 2007. Application No. 60/881,720 is hereby incorporated by reference.

BACKGROUND OF THE INVENTION (1) Field of the Invention

The present invention generally relates to a spline apparatus.

(2) Description of the Prior Art

Screen frames, screen spline and related devices are disclosed in U.S. Pat. Nos. 5,046,546, 5,345,662, 6,279,644 and 6,945,305.

SUMMARY OF THE INVENTION

It is a primary object and general purpose of the present invention to provide an apparatus for securing a screen to a frame member. The invention includes a spline apparatus, a frame member, a center divider, and an "R" channel member that can be used to join several frame members together to form a continuous section of screen panels.

The spline apparatus of the present invention comprises a spline section for insertion into a spline channel of a frame member, a spline channel cover section and an intermediate section that is joined to and between the spline section and spline channel cover section. When the spline section is disposed within a spline channel of a frame member, the spline channel cover section hides or obscures the view of the spline channel and spline section thereby providing an aesthetically pleasing appearance.

Other aspects of the invention are described in detail in the ensuing description.

BRIEF DESCRIPTION OF THE DRAWINGS

The features of the invention are believed to be novel. The figures are for illustration purposes only and are not drawn to scale. The invention itself, however, both as to organization and method of operation, may best be understood by reference to the detailed description which follows taken in conjunction with the accompanying drawings in which.

DESCRIPTION OF THE PREFERRED EMBODIMENTS

Figure 1A:
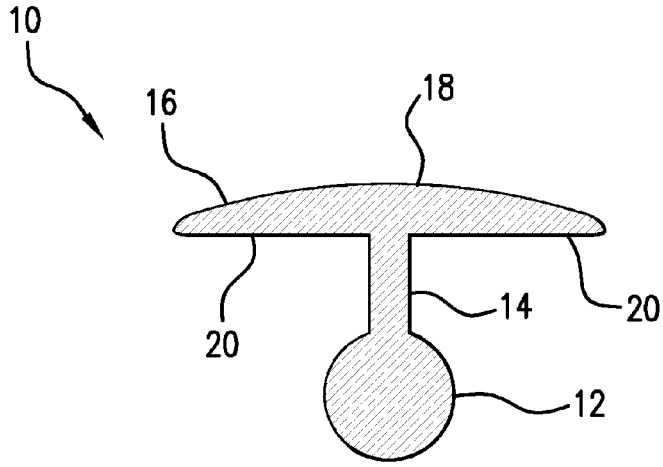
FIG. 1A is a cross-sectional view a spline apparatus in accordance with one embodiment of the present invention.
Figure 1B:
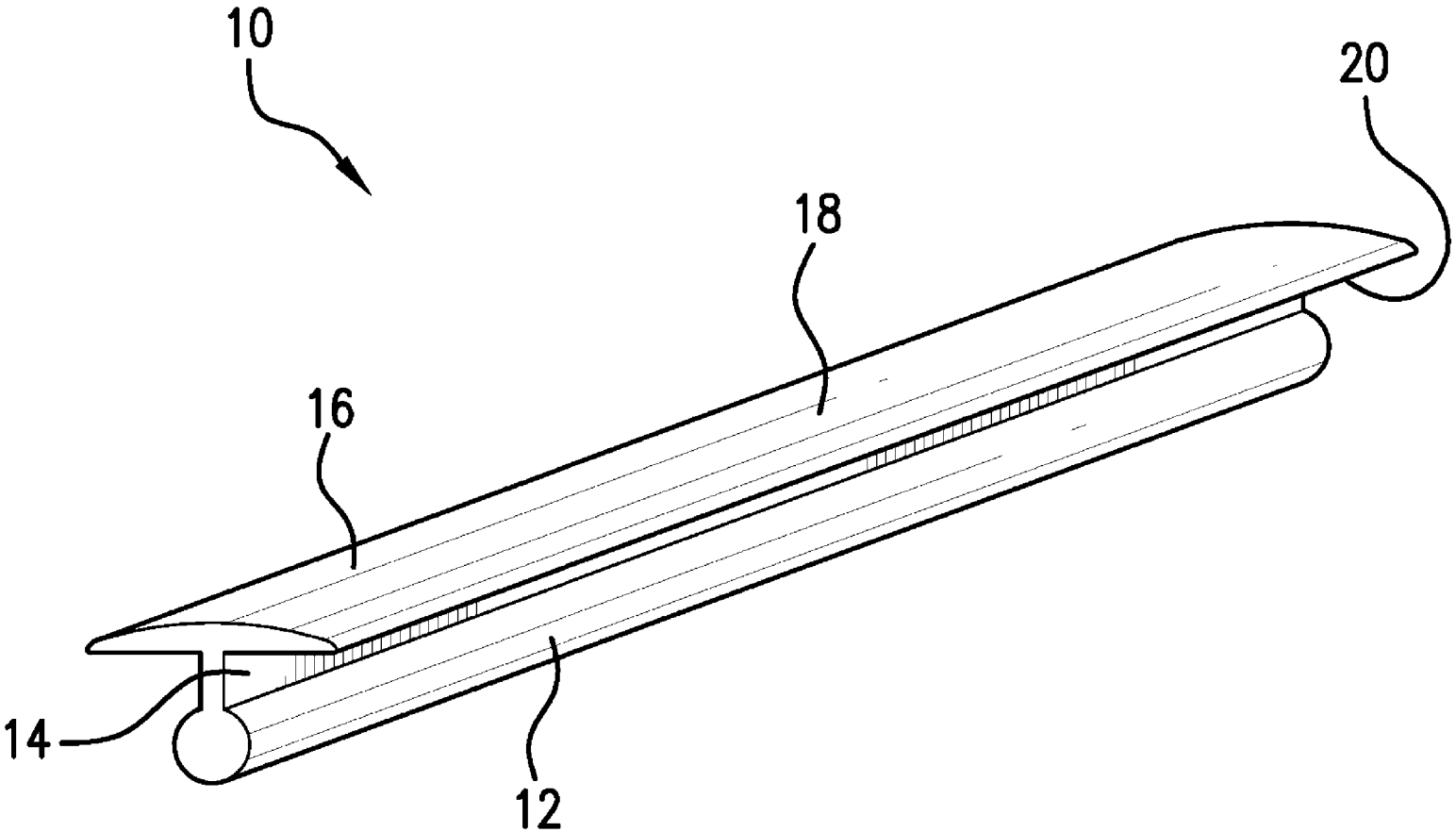
FIG. 1B is a perspective view of the spline apparatus of FIG. 1A.
Figure 3:
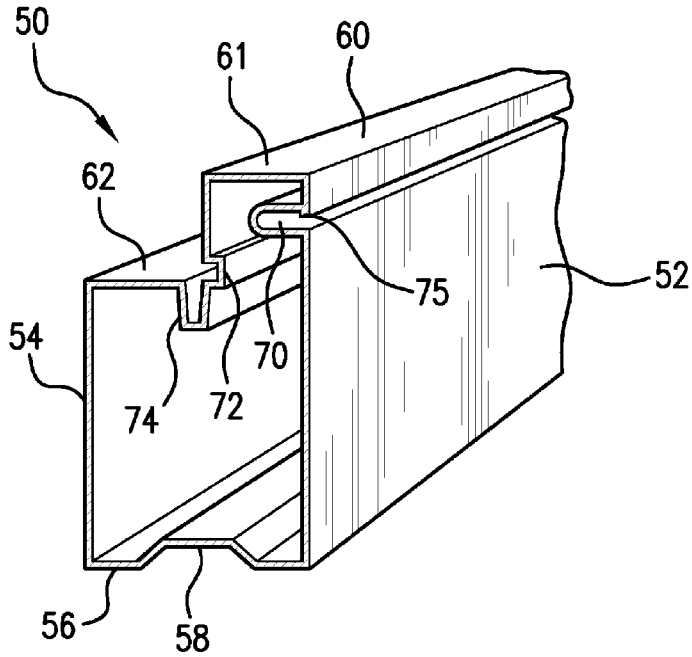
FIG. 3 is a perspective view of the frame member shown in FIG. 2.
Figure 4:
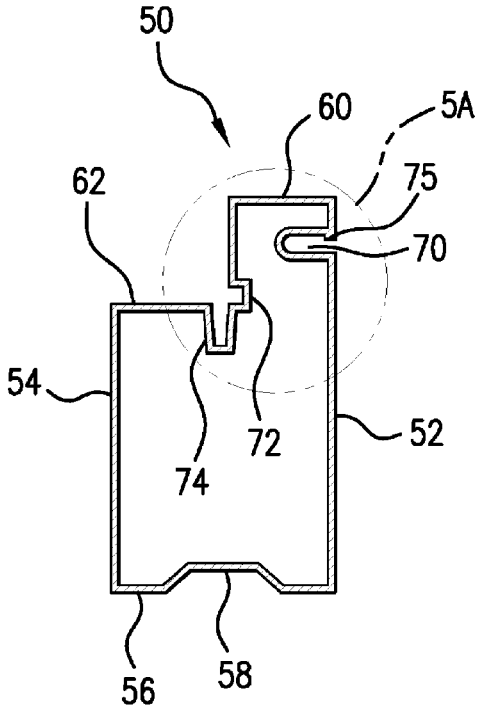
FIG. 4 is an end view of the frame member of FIG. 2.

Referring now to the drawings in detail wherein like numerals indicate the elements throughout the several views, FIG. 1A depicts a cross-sectional view of spline apparatus 10 in accordance with one embodiment of the present invention. Referring to FIGS. 1A and 1B, spline apparatus 10 comprises spline section 12, central section 14 and cover section 16. Central section 14 is between and joined to spline section 12 and cover section 16. Spline section 12 is sized to frictionally fit within a spline channel in a frame member or a center divider member as will be explained in the ensuing description. In one embodiment, spline section 12 has a generally round shape. The outer surface of spline section 12 can be smooth, or it can be configured to be rough or serrated. Spline section 12 can be configured to be solid or hollow. Central section 14 is connected to spline section 12 and cover section 16. In one embodiment, cover section 16 has a generally curved or convex exterior side 18 and a generally flat interior side 20. In another embodiment, exterior side 18 is generally flat. Spline apparatus 10 can be made from any one of a variety of suitable resilient materials such as rubber, foam, and poly-foam. The dimensions of spline apparatus 10, including its length, may be varied so that it can be used with screen frames of different dimensions. Spline apparatus 10 can be configured to have a color that matches the color of the screen frame with which spline apparatus 10 is used.

Figure 5A:
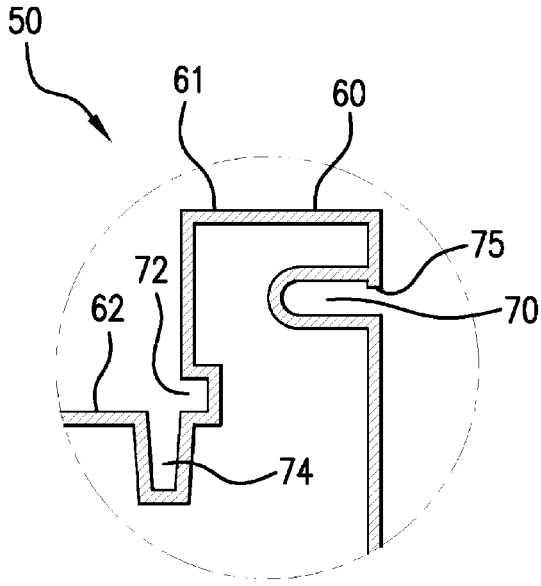
FIG. 5A is an enlarged view of a portion of the view of FIG. 4.
Figure 5B:
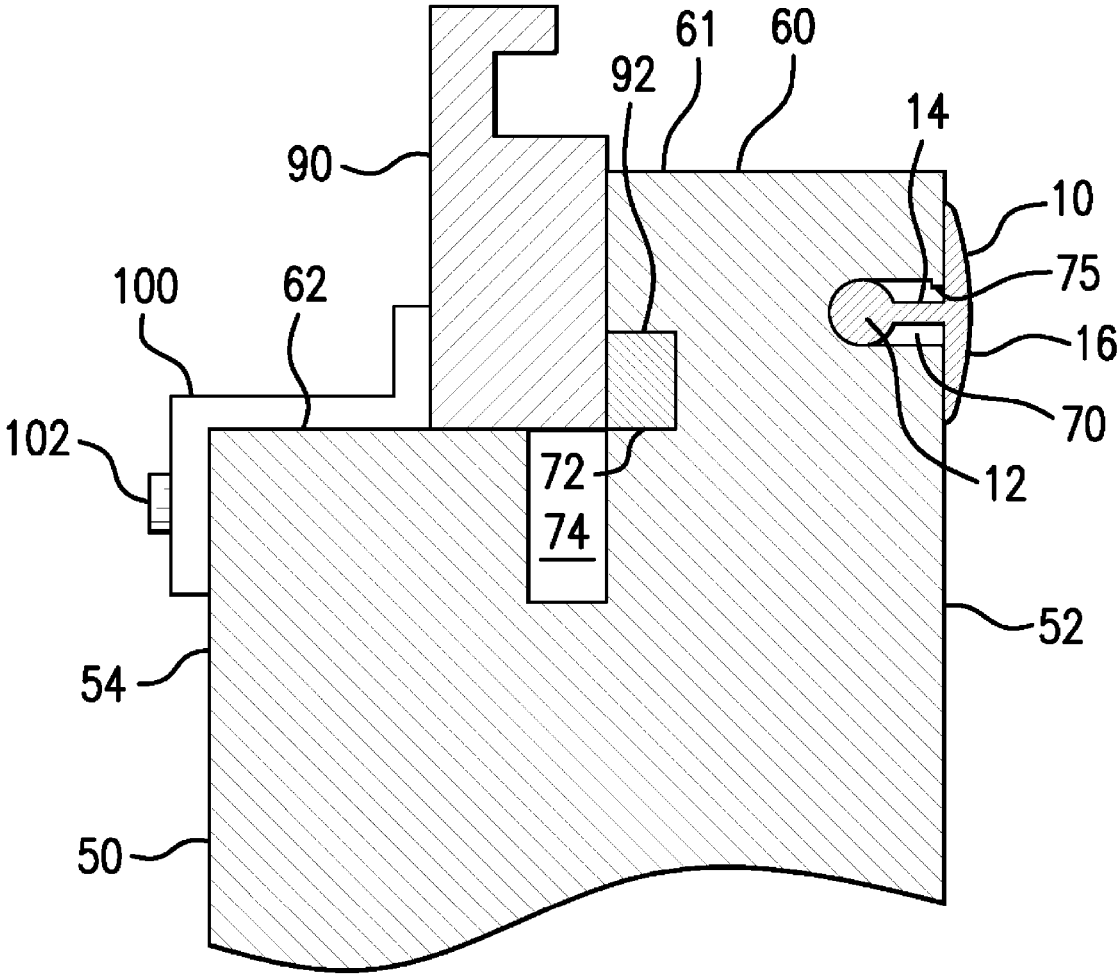
FIG. 5B is a partial, cross-sectional view showing a portion of screen member removably secured to the frame member of FIG. 2.
Figure 5C:
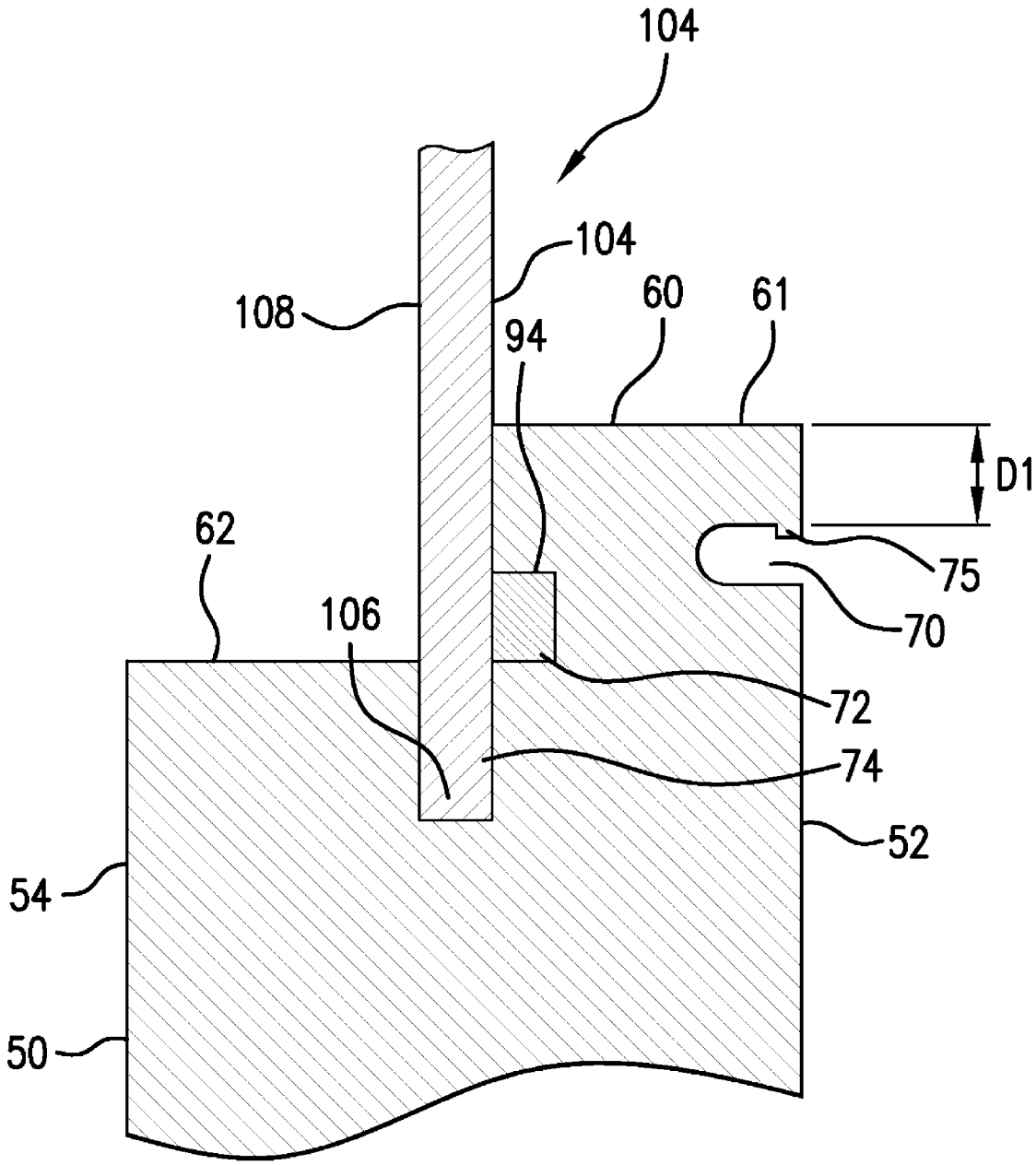
FIG. 5C is view, similar to the view of FIG. 5B, which shows a kick plate secured to the frame member shown in FIG. 2.

In one embodiment of the present invention, spline apparatus 10 is used with frame member 50 of the present invention which is shown in FIGS. 3, 4, 5A, 5B and 5C. Frame member 50 comprises exterior side 52, interior side 54, and lengthwise end portion 56. Lengthwise end portion 56 includes longitudinally extending channel or canal 58. The purpose of channel 58 is discussed in the ensuing description. Frame member 50 includes lengthwise end portion 60 which has surface 61. Frame member 50 further includes longitudinally extending shoulder 62. Frame member 50 further includes longitudinally extending channels 70, 72 and 74. Channel 70 is located within and extends along lengthwise end portion 60. Referring to FIG. 5C, frame member 50 further includes nub 75 which helps keep spline section 12 within channel 70.

Figure 2:
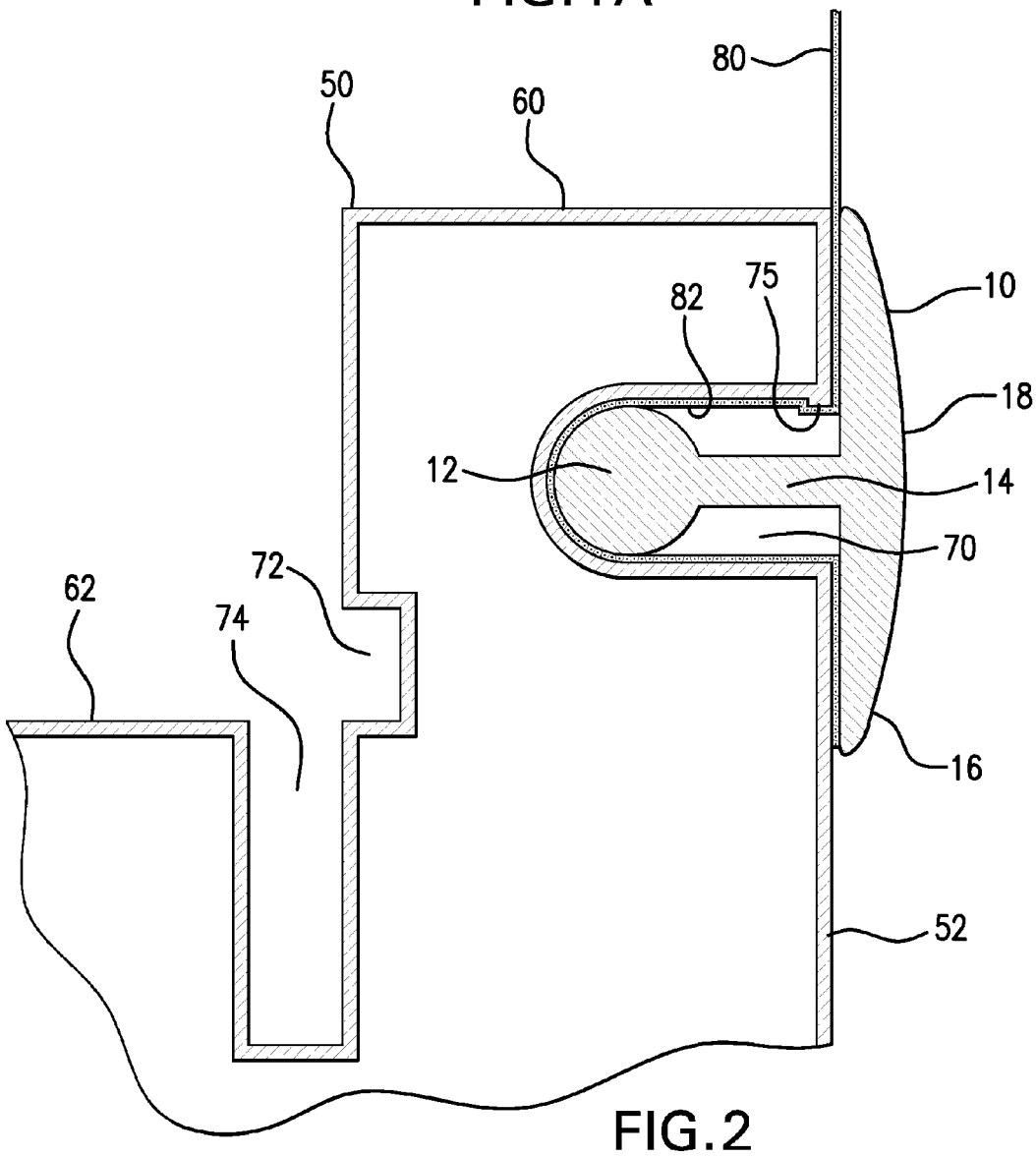
FIG. 2 is a cross-sectional view of the spline apparatus of FIG. 1 and a frame member of the present invention, the spline apparatus being attached to the frame member.

Referring to FIGS. 1A, 1B, 2 and 3, spline apparatus 10 has a length that is the same as the length of channel 70. Channel 70, spline apparatus 10 and nub 75 cooperate to secure screen 80 to frame member 50. Specifically, channel 70 has a size and dimensions that allow peripheral portion 82 of screen 80 and spline section 12 to be frictionally inserted into channel 70 so as to secure screen 80 to frame member 50. In order to secure screen 80 to frame member 50, peripheral portion 82 is first inserted into channel 70 and then spline section 12 is inserted thereafter into channel 70 such that peripheral portion 82 is tightly positioned between the inner walls of channel 70 and spline section 12. When spline apparatus 10 is completely attached to frame member 50, a portion of screen 80 is positioned between inner surface 20 of cover section 16 and exterior side 52 of frame member 50. As shown in FIG. 2, cover section 16 hides or obscures the view of channel 70. Thus, outer surface 18 provides a more aesthetically pleasing appearance.

Frame member 50 is preferably in the shape of a rectangular or square so as to match the corresponding opening in which the main frame assembly is to be installed. However, frame member 50 may be configured to have any other shape. Frame member 50 can be made from any one of a variety of materials, e.g. wood, aluminum, plastic, resin, polycarbonate, composites, etc.

Referring to FIGS. 5A and 5B, frame member 50 provides the option to a user to secure a removable screen or removable glazed insert assembly to frame member 50. In one embodiment, as shown in FIG. 5B, removable screen 90 is removably secured to frame member 50. Removable screen 90 includes a strip of pile or weather seal 92. Removable screen 90 is mounted on top of shoulder 62 and abuts frame member 50 such that pile 92 is disposed within channel 72. Clamp 100 is removably attached to side 54 of frame member 50 via fastening device 102 and further retains removable screen 90 in place.

Referring now to FIG. 5C, frame member 50 also provides an option to secure a kick plate 104 thereto. Kick plate 104 has a lower peripheral portion 106 that is positioned in channel 74 and an upper portion 108. An amount of glue or adhesive 94 can be disposed in channel 72 so as to retain kick plate 104 in place.

Referring to FIG. 5C, another important feature of frame member 50 is that the distance "D1" between surface 61 and channel 70 is significantly greater than the corresponding distance in prior art frame members. For example, in one embodiment, the distance "D1" is 3/16 inch.

Figure 6:
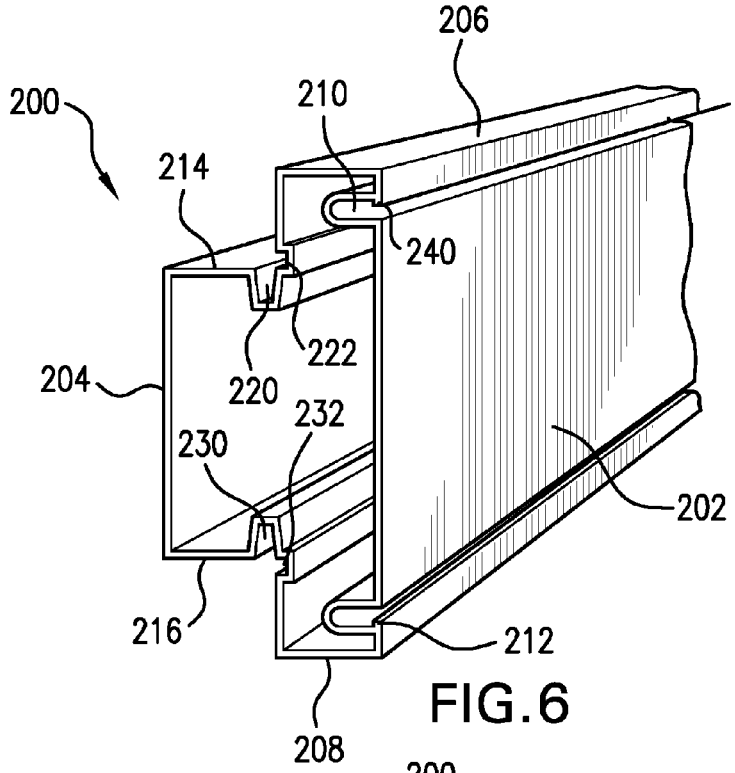
FIG. 6 is a perspective view of a center divider in accordance with another embodiment of the present invention.
Figure 7:
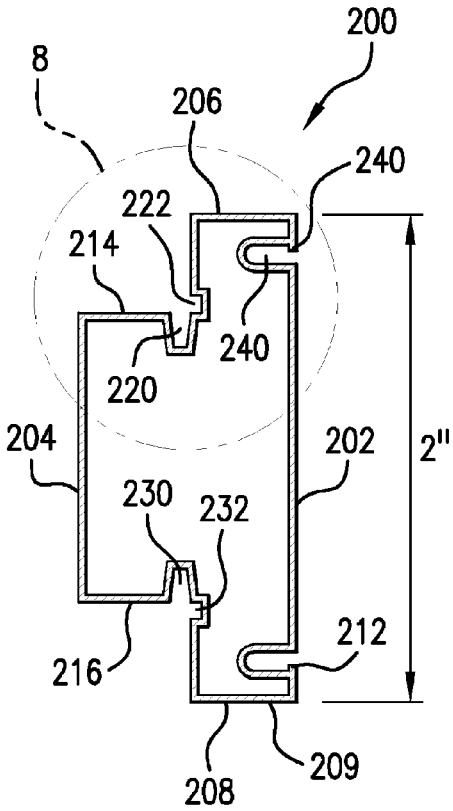
FIG. 7 is a cross-sectional view of the center divider of FIG. 6.
Figure 8:
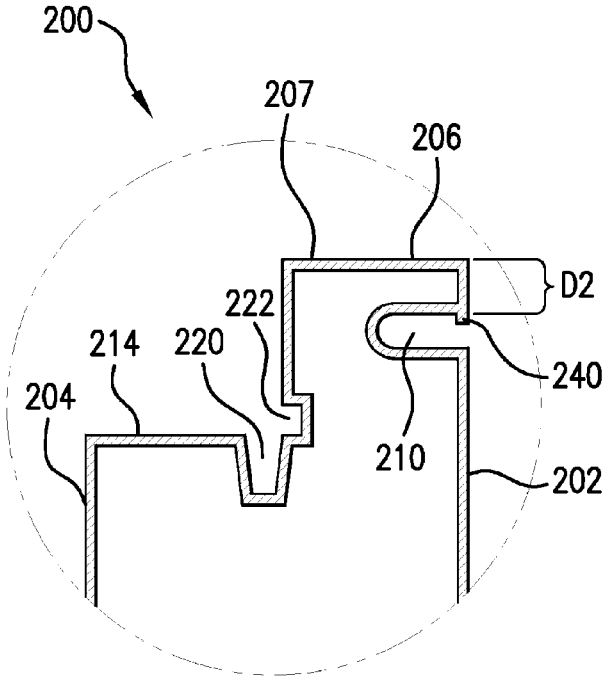
FIG. 8 is an enlarged view of a portion of the view of FIG. 7.

Referring to FIGS. 6-8, there is shown center divider (or "center bar") 200 in accordance with another embodiment of the present invention. Center divider 200 is part of an overall frame system. Spline apparatus 10 can be used with center divider 200. Center divider 200 comprises exterior side 202, interior side 204 and lengthwise end portion 206. Lengthwise end portion 206 includes surface 207. Center divider 200 further comprises lengthwise end portion 208. Lengthwise end portion 206 has longitudinally extending channel or canal 210. Similarly, lengthwise end portion 208 has channel or canal 212. Channel 210 is sized so as to allow the peripheral portion of a screen and the spline section 12 to be frictionally inserted into channel 210. The structure, function and purpose of channel 210 are the same as that of channel 70 of frame member 50 (see FIGS. 2-4). Similarly, channel 212 is sized so as to allow the peripheral portion of a screen and the spline section 12 to be frictionally inserted into channel 212. The structure, function and purpose of channel 212 are the same as that of channel 70 of frame member 50 (see FIGS. 2-4).

Referring to FIG. 8, an important feature of center divider 200 is that the distance "D2" between edge 207 of end portion 206 and channel 210 is significantly greater than such a corresponding distance in prior art center dividers or center bars. The distance between channel 212 and the outer surface 209 of end portion 208 is the same as distance "D2".

As shown in FIGS. 6-8, center divider 200 includes longitudinally extending shoulders 214 and 216. Center divider 200 further includes longitudinally extending channels 220 and 222 which are proximate to longitudinally extending shoulder 214. The structure, functions and purposes of channel 220 are the same as that of channel 74 of frame member 50 (see FIGS. 2, 3, 4, 5A, 5B and 5C). Similarly, the structure, functions and purposes of channel 222 are the same as that of channel 72 of frame member 50 (see FIGS. 2, 3, 4, 5A, 5B and 5C).

Center divider 200 further includes longitudinally extending channels 230 and 232 which are proximate to longitudinally extending shoulder 216. The structure, functions and purposes of channel 230 are the same as that of channel 74 of frame member 50 (see FIGS. 2, 3, 4, 5A, 5B and 5C). Similarly, the structure, functions and purposes of channel 232 are the same as that of channel 72 of frame member 50 (see FIGS. 2, 3, 4, 5A, 5B and 5C). As can be seen FIG. 6, the bottom portion of center divider 200 is a mirror image of the top half of center divider 200. Center divider 200 can be made from any one of a variety of materials, e.g. wood, aluminum, plastic, resin, polycarbonate, composites, etc.

As shown in FIG. 8, in one embodiment, center divider 200 includes a nub 240 that is located within channel 210. Nub 240 helps keep spline section 12 of spline apparatus 10 positioned within channel 210. Similarly, center divider 200 includes a nub (not shown) positioned within channel 212.

Center divider (or center bar) 200 is used to break up large panels manufactured from frame sections 50 and frame sections 300 (which are described in the ensuing description). Center divider 200 can be used with either spline apparatus 10 or commonly available spline. If center divider 200 is used with a main frame and an interchangeable screen or glazed panels, then spline apparatus 10 can be used to hide or obscure empty spline channels. Center divider 200 also can be used with a kick plate.

Figure 9:
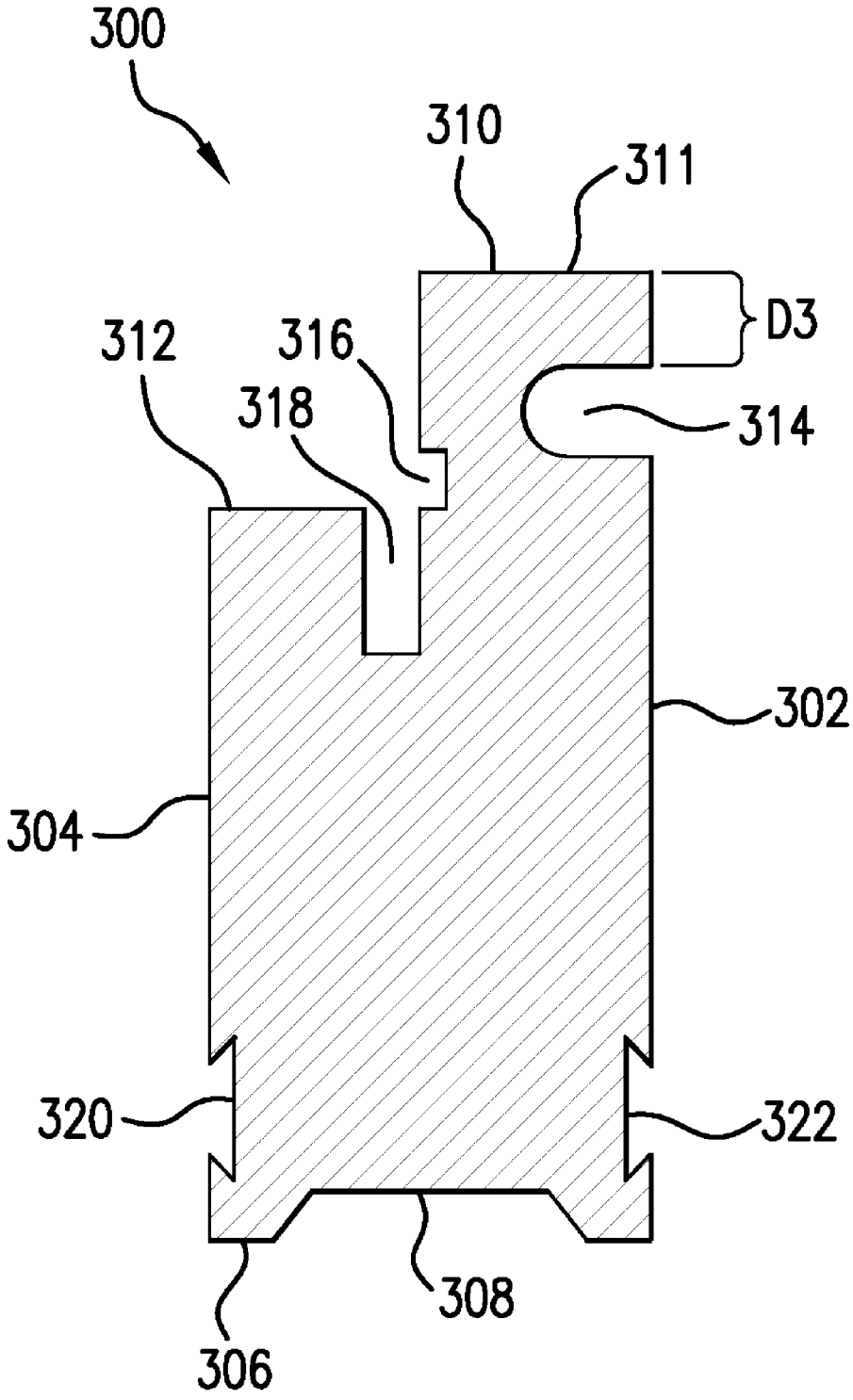
FIG. 9 is a cross-sectional view of a frame member in accordance with a further embodiment of the invention.

Referring to FIG. 9, there is shown a cross-sectional view of frame member 300 in accordance with a further embodiment of the present invention. Spline apparatus 10 can also be used with frame member 300. Frame member 300 comprises exterior side 302, interior side 304, lengthwise end portion 306 and longitudinally extending channel or canal 308. The purpose of channel 308 is discussed in the ensuing description. Frame member 300 includes lengthwise end portion 310. Lengthwise end portion 310 has surface 311.

Frame member 300 has longitudinally extending shoulder 312. The structure, function and purpose of lengthwise end portion 310 are the same as that of lengthwise end portion 60 of screen frame 50 (see FIGS. 2, 3 and 4). Screen frame 300 further includes longitudinally extending channels 314, 316 and 318. Channel 314 is proximate to lengthwise end portion 310 and extends for substantially the entire length of screen frame 300. The structure, purpose and function of channel 314 are the same as that of channel 70 of frame member 50. An important feature of frame member 300 is that the distance "D3" between edge 311 and channel 314 is significantly greater than the corresponding distance in prior art frame members.

Referring to FIG. 9, channels 316 and 318 are proximate to longitudinally extending shoulder 312. The structure, purpose and function of channel 316 are the same as that of channel 72 of frame member 50. The structure, purpose and function of channel 318 are the same as that of channel 74 of frame member 50. Frame member 300 can be made from any one of a variety of materials, e.g. wood, aluminum, plastic, resin, polycarbonate, composites, etc.

As shown in FIG. 9, frame member 300 further includes longitudinally extending pile channels 320 and 322 for receiving pile, also known as weather seal. Pile channel 320 is formed in side 304. Pile channel 322 is formed in side 302. In one embodiment, glue or adhesive is used to retain the pile in place. Frame member 300 can be made from any one of a variety of materials, e.g. wood, aluminum, plastic, resin, polycarbonate, composites, etc.

Frame members 50 and 300 may be used to manufacture a frame panel. The particular structure of frame member 50 and 300 allow these frame members to be used to form a stand-alone screen frame with conventional spline or with spline apparatus 10. Frame members 50 and 300 can also be used to form a main frame that will receive interchangeable screen and glazed panels. In such an embodiment, spline apparatus 10 is used to hide the empty spline channels. Frame members 50 and 300 can also be used with kick plates.

Figure 10:
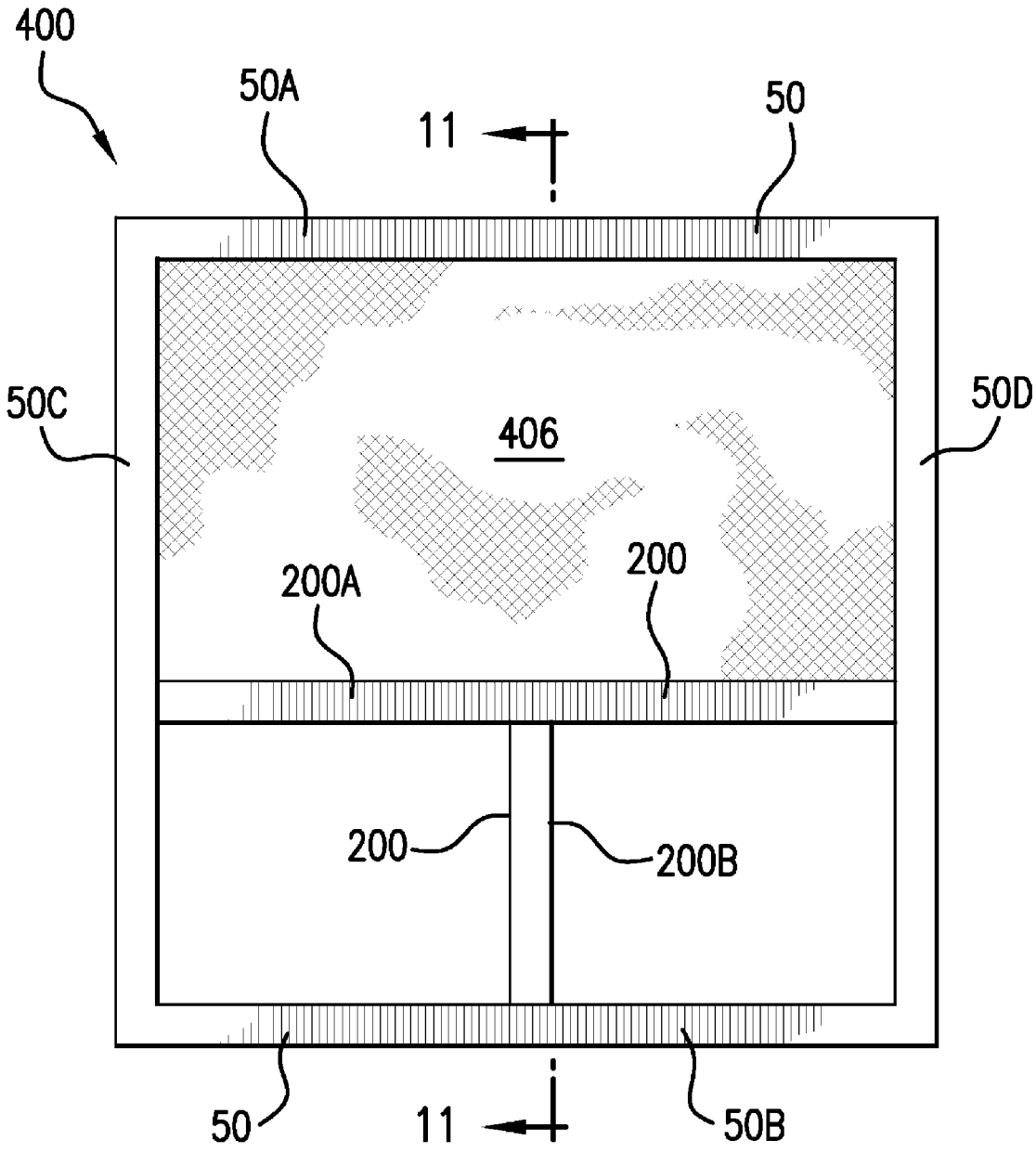
FIG. 10 is a front elevational view of a main frame assembly that utilizes the frame member and center divider shown in FIGS. 2 and 6, respectively.
Figure 11:
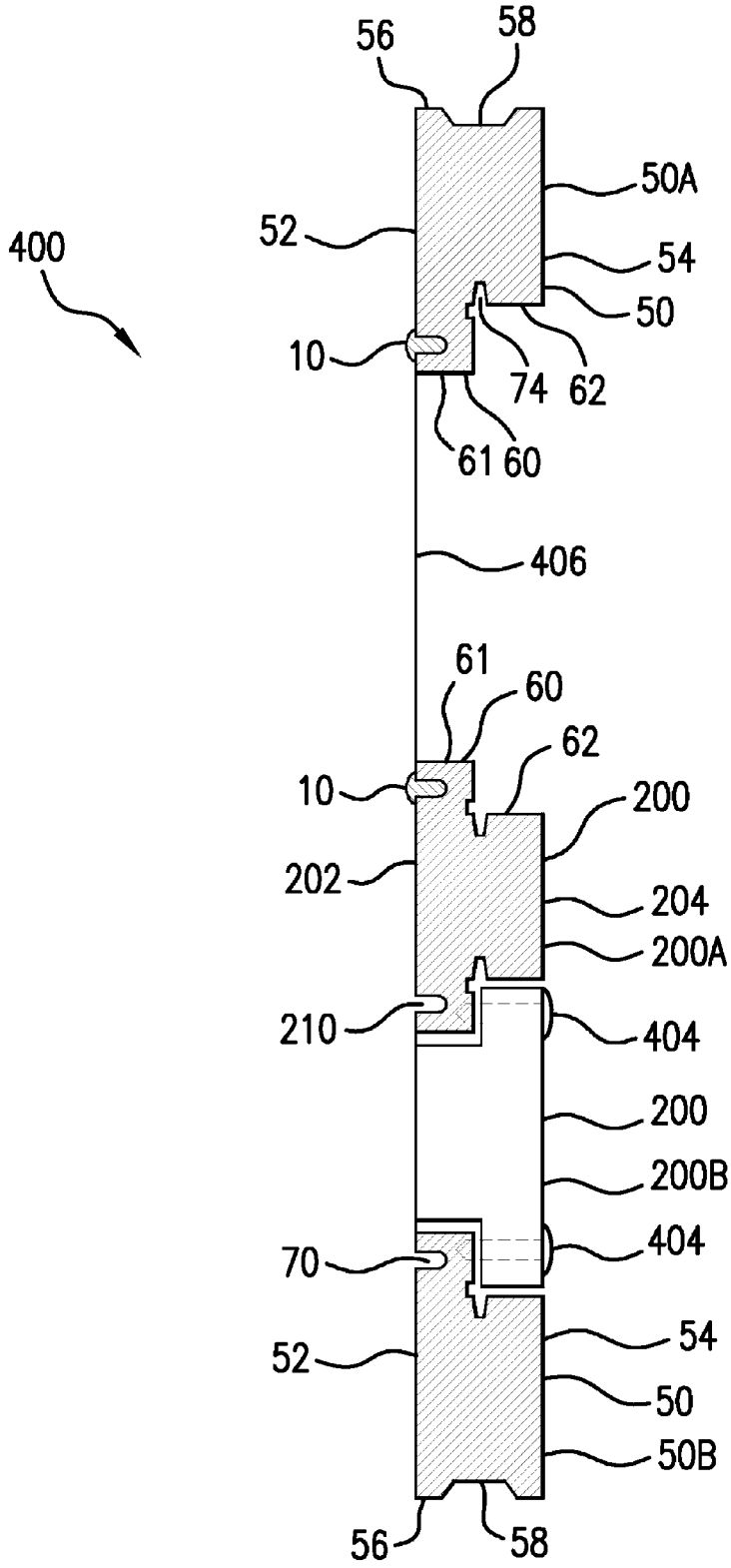
FIG. 11 is a cross-sectional view taken along line 11-11 in FIG. 10.

Referring to FIGS. 10 and 11, there is shown a complete frame assembly 400 which comprises center dividers 200 and a plurality of frame members 50. The upper one of frame member 50 is indicated by reference number 50A, the lower one of frame members 50 is indicated by reference number 50B. The left and right frame members 50 are designated by reference numbers 50C and 50D, respectively. Center dividers 200 include horizontally oriented center divider 200A and vertically oriented center divider 200B. Center divider 200B is connected to horizontally oriented center divider 200A and lower frame section 50B. Fastening devices 404, such as screws, are used to connect vertically oriented center divider 200B to horizontally oriented center divider 200A and lower frame member 50B. Frame assembly 400 includes screen material 406. Conventional spline or spline apparatus 10 may be used with frame members 50A, 50B, 50C and 50D. The ability to use both horizontally oriented center divider 200A and vertical oriented center divider 200B as well as in conjunction with one another and with frame members 50 allows construction of relatively large frame assemblies having a plurality of divided openings.

Figure 12:
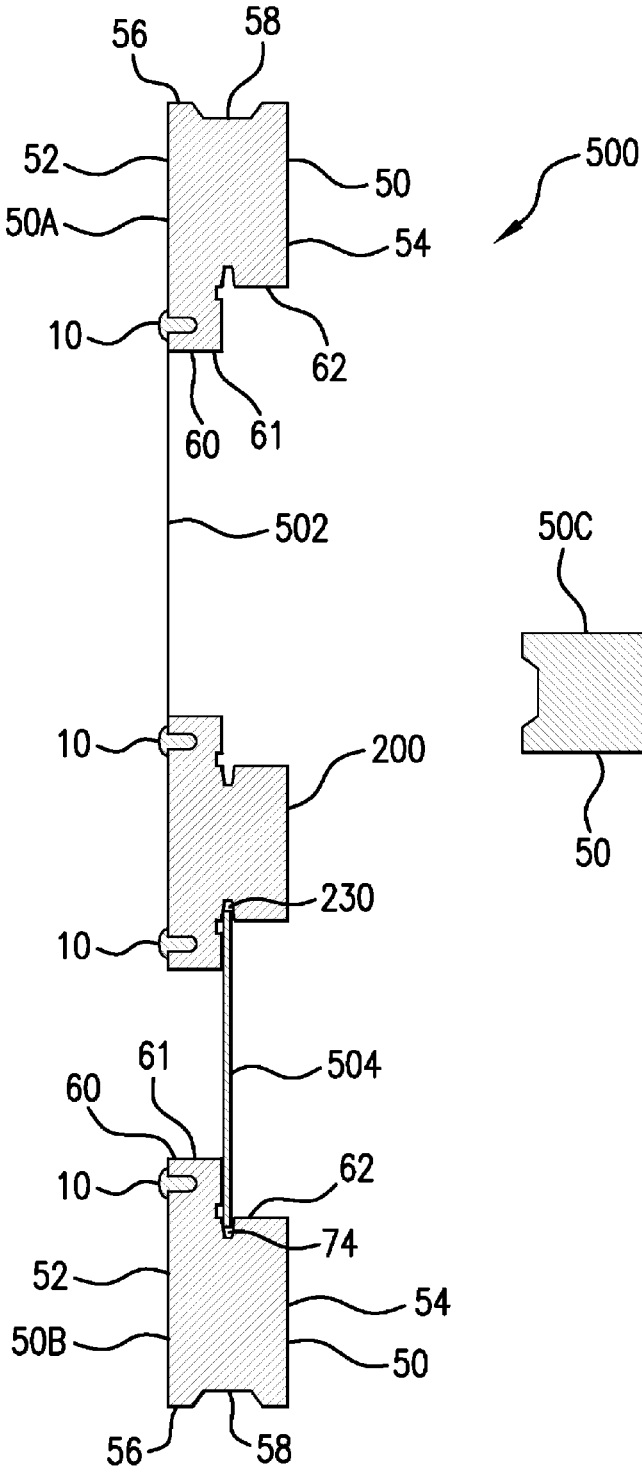
FIG. 12 is a cross-sectional view, similar to the view in FIG. 11, of another main frame assembly.
Figure 13:
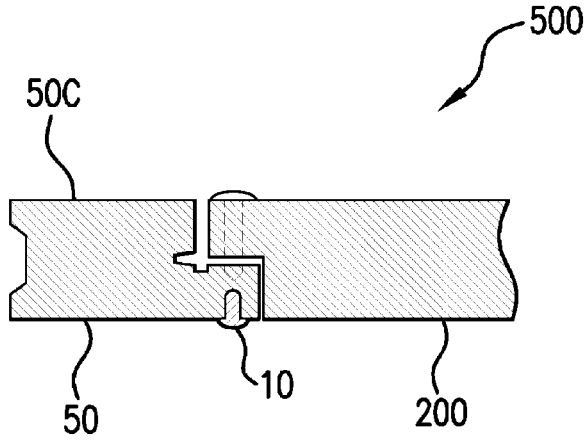
FIG. 13 is a partial, cross-sectional view showing the interconnection of a frame member and the center divider member that is part of the main frame assembly of FIG. 12.

Referring to FIGS. 12 and 13, there is shown another main frame assembly 500 using the components of the present invention and a kick plate. FIG. 12 is a cross-sectional view of the main frame assembly 500, the view of FIG. 12 being similar to the type of view shown in FIG. 11. Main frame assembly 500 comprises frame members 50, center divider 200, screen material 502, and kick plate 504. The plurality of frame members 50 include upper frame member 50A, lower frame member 50B, and left and right frame members which are similar to frame members 50C and 50D in FIG. 10. The left frame member 50 of main frame assembly 500 is indicated by reference number 50C (see FIG. 13). Spline apparatuses 10 are used to secure screen material 502 in channels 70 of the frame members 50. Alternatively, conventional spline can be used instead of spline apparatuses 10. Kick plate 504 is secured in channel 230 of center divider 200 and channel 74 of lower frame member 50B. Spline apparatus 10 can also be inserted into any unused (i.e. open) spline channels 70. In an alternate embodiment, kick plate 504 is not used and additional screen material, such as screen material 502, is secured to center divider 200 and lower frame member 50B. Thus, in such an embodiment, screen material is above and below center bar 200.

Figure 14:
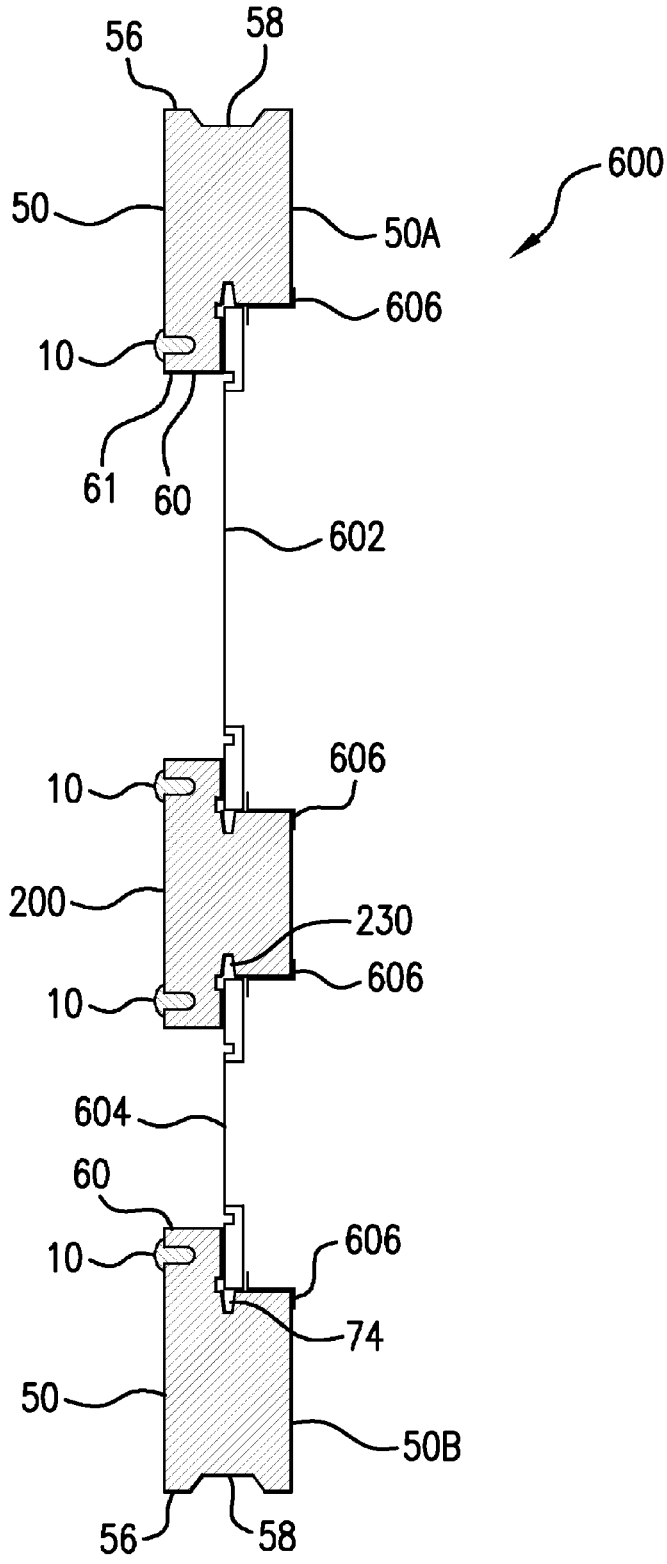
FIG. 14 is a cross-sectional view, similar to the view in FIG. 11, of another main frame assembly.

Referring to FIG. 14, there is shown a side view, in cross-section, of frame assembly 600. The view shown in FIG. 14 is similar to the type of views shown in FIGS. 11 and 12. Frame assembly 600 comprises a plurality of frame members 50, center divider 200, screen insert 602 and glazed insert 604. The plurality of frame members 50 include an upper frame member 50A and lower frame member 50B. Frame assembly 600 does not use a kick plate. Clips 606 are attached to frame members 50 and center divider 200 and secure screen insert 602 and glazed insert 604 to the frame members 50 and center divider 200. Frame assembly 600 provides the option of swapping screen insert 602 and glazed insert 604 so that screen insert 602 is positioned below center divider 200 and glazed insert 604 is above center divider 200. Spline apparatuses 10 are used to cover unused or open spline channels 70 of frame members 50. In an alternate embodiment, spline channels 70 of frame members 50 are left open. In an alternate embodiment, glazed insert 604 is replaced by a kick plate that is secured within channel 230 of center divider 200 and within channel 74 of frame member 50B.

Figure 15:
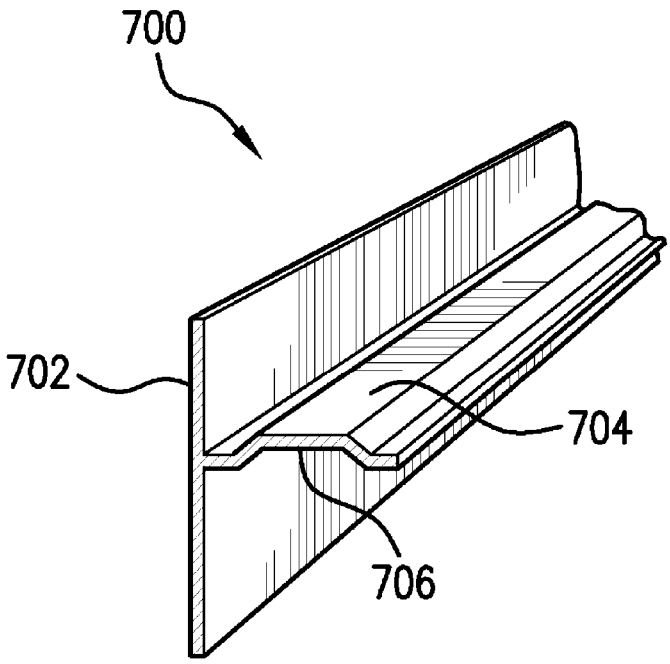
FIG. 15 is a perspective view of an "R" channel member in accordance with one embodiment of the present invention.
Figure 16:
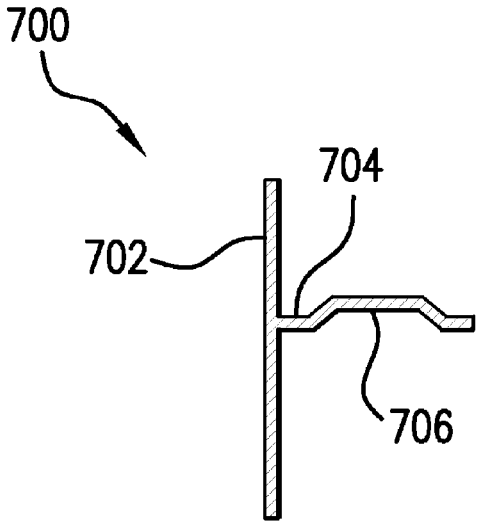
FIG. 16 is a cross-sectional view of the "R" channel member shown in FIG. 15.
Figure 17:
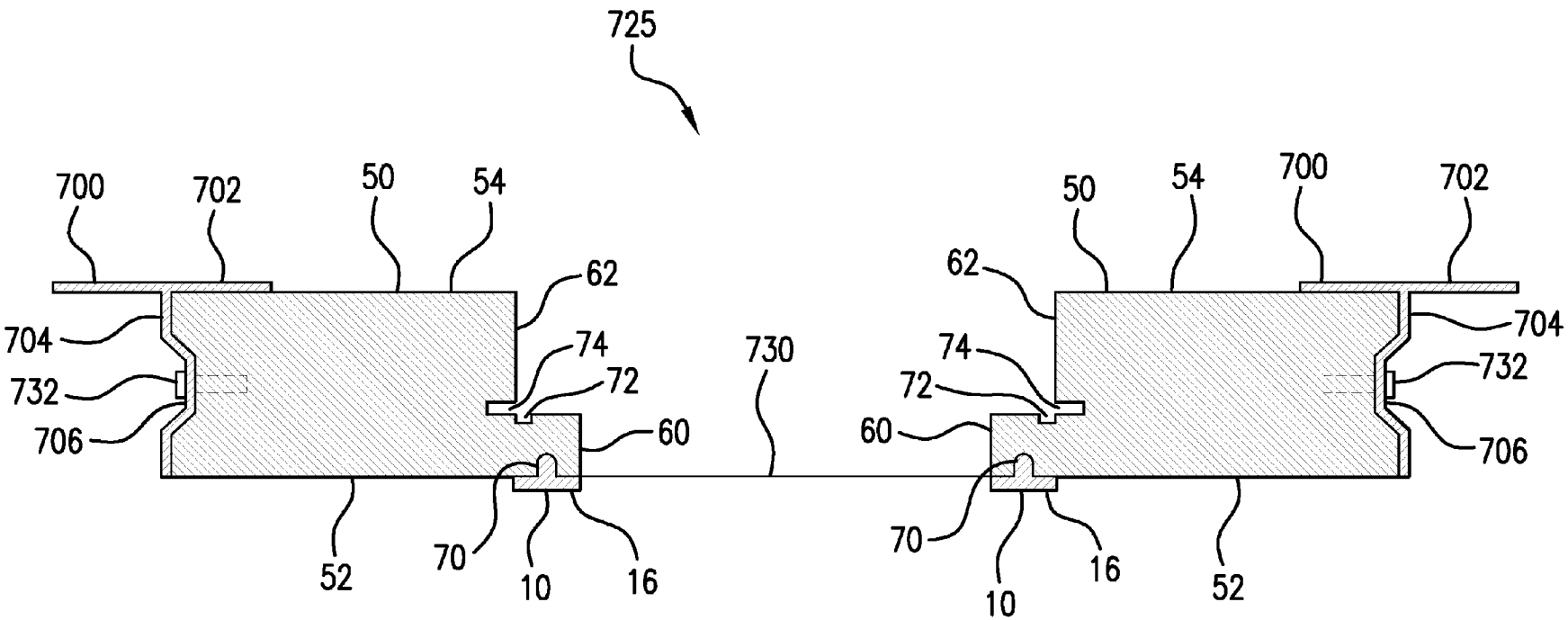
FIG. 17 is a cross-sectional view showing the interconnection of the "R" channel member of FIG. 15, the frame member of FIG. 2, and the spline apparatus of FIG. 1.

Referring to FIGS. 15, 16 and 17, there is shown an "R" channel member 700 in accordance with the invention. The "R" channel member 700 is configured for use in mounting a screen frame, or joining assembled screen frames. As will be explained by the ensuing description, "R" channel member 700 can be used with screen frames 50 and 300. The "R" channel member 700 comprises a generally flat plate section 702 and section 704 which is configured to have a channel section 706. As shown in FIG. 16, channel 706 has a generally trapezoidal shape. In a preferred embodiment, section 704 is rigidly attached to flat plate 702.

FIG. 17 illustrates how spline apparatus 10, frame member 50 and "R" channel member 700 are used to assemble a complete frame assembly 725 for use in an opening. FIG. 17 is a partial, cross-sectional view of frame assembly 725 that utilizes a plurality of spline apparatuses 10, a plurality of frame members 50, a plurality of "R" channel members 700 and screen section 730. The channel section 706 of each "R" channel member 700 is configured to fit within channel 58 of each frame member 50. Fastening devices 732, such as nails or screws, are used to attach each "R" channel member 700 to the corresponding frame member 50. Spline apparatuses 10 secure screen section 730 to frame members 50 in the manner described in the foregoing description.

Figure 18:
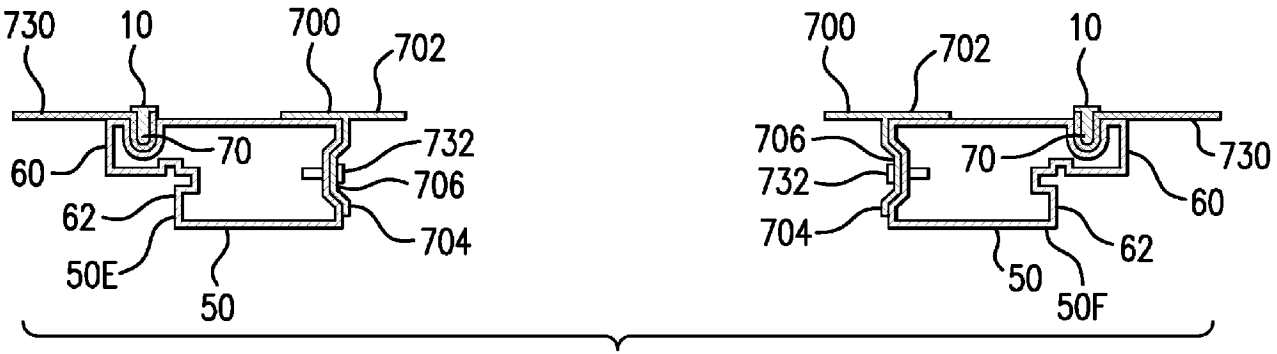
FIGS. 18-20 are partial views, in cross-section, illustrating the interconnection of the frame members, shown in FIG. 2, and the "R" channel member shown in FIG. 15.
Figure 19:
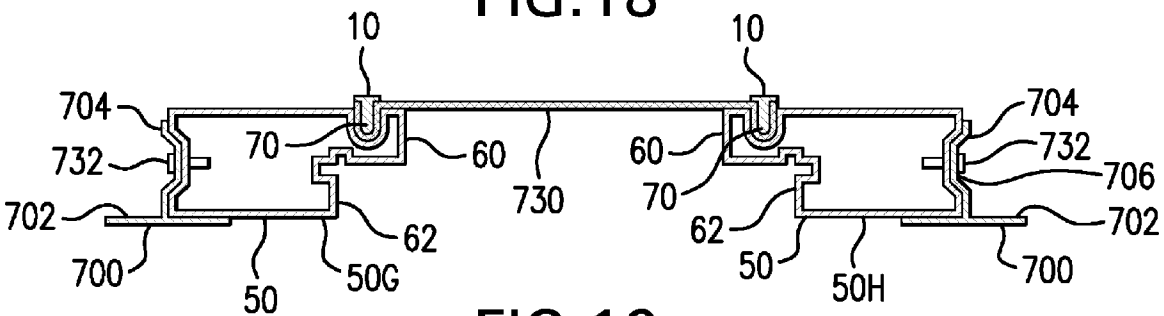
Figure 20:
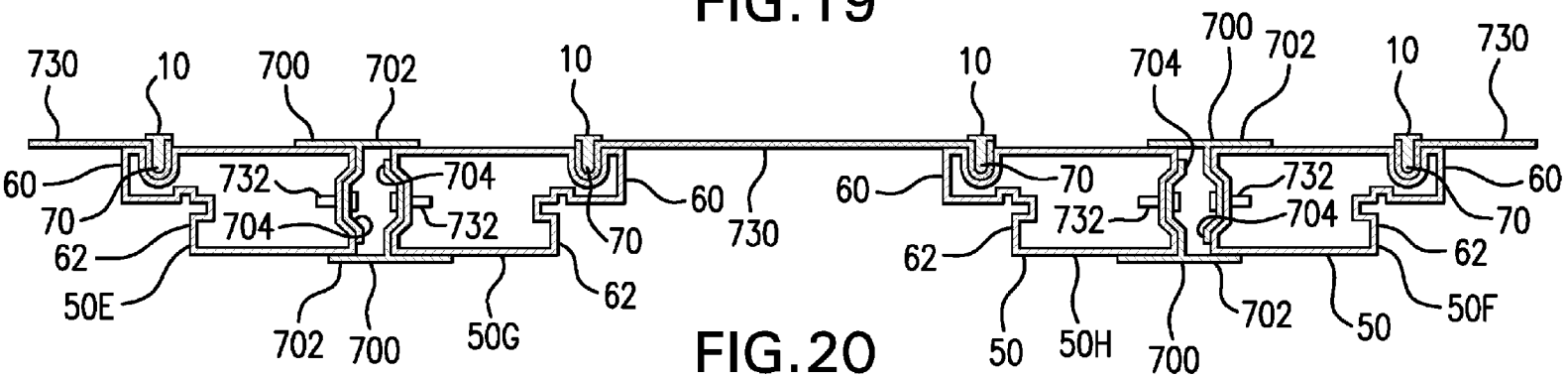

Referring to FIGS. 18, 19 and 20, there is illustrated the process for assembling a frame assembly using frame members 50, "R" channel members 700, screen sections 730 and spline apparatuses 10. Frame members 50 include frame members 50E, 50F, 50G and 50H. First, as shown in FIG. 18, the exterior "R" channel members 700 are attached to frame members 50E and 50F using fastening devices 732. Next, the interior "R" channel members 700 are attached to frame members 50G and 50H using fastening devices 732. Referring to FIG. 20, the exterior and interior "R" channel members 700 are then locked in place to provide a clean finish. It is to be understood that the view shown in FIG. 20 is a partial view of a completed frame assembly. Spline apparatuses 10 are used to secure screen 730 into channels 70 in frame members 50.

In other embodiments, conventional spline may be used in channels 70, 210 and 314 of screen frames 50, 200 and 300, respectively. Such conventional spline includes hollow serrated spline, smooth hollow spline, "T" spline, poly-foam spline, flat spline and rigid spline.

Figure 21:
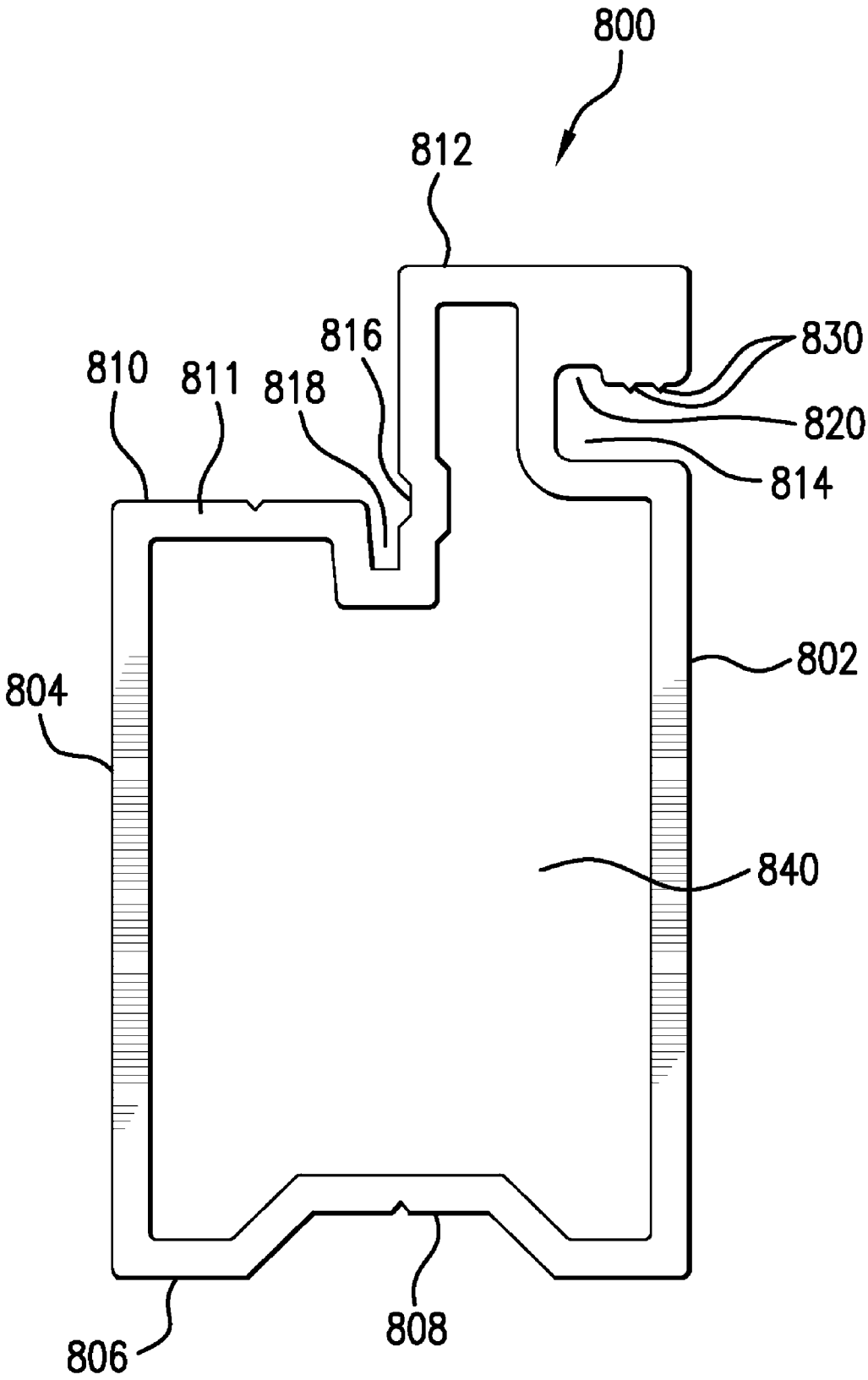
FIG. 21 is an end view of a frame member in accordance with another embodiment of the present invention.

Referring to FIG. 21, there is shown a frame member 800 in accordance with a further embodiment of the present invention. Frame member 800 extends longitudinally as does frame member 50 (see FIG. 3). Frame member 800 comprises exterior side 802, interior side 804 and lengthwise end portion 806. Lengthwise end portion 806 includes a longitudinally extending channel 808 which serves the same purpose as channel 58 of frame member 50 (see FIG. 3). Frame member 800 includes longitudinally extending shoulder portion 810 which has surface 811. Frame member 800 further comprises lengthwise end portion 812 that extends longitudinally (i.e. along the length of frame member 800). Frame member 800 further comprises longitudinally extending channels 814, 816 and 818 which serve generally the same purpose as channels 70, 72 and 74, respectively, of frame member 50 (see FIGS. 3-5B). Thus, channel 814 is a spline channel and is configured to receive spline apparatus 10 described in the foregoing description. However, channel 814 has a shape that is different than the shape of channel 70 of frame member 50. Specifically, channel 814 has portion 820 that extends deeper into end portion 812. Frame member 800 further comprises nubs 830 that help keep spline section 12 of spline apparatus 10 within channel 814. In a preferred embodiment, the portion of the spline section 12 that is inserted into channel 814 has a shape that generally conforms to the shape of the channel 814. In one embodiment, frame member 800 has a hollow interior 840. In another embodiment, frame member 800 is of solid construction. In one embodiment, frame member 800 is fabricated from metal, such as aluminum. However, other suitable materials can be used, such as plastic. If plastic is used, then it is preferred if an extrusion process is used to form frame member 800. Conventional spline may be used in spline channel 814 instead of spline apparatus 10.

Figure 22:
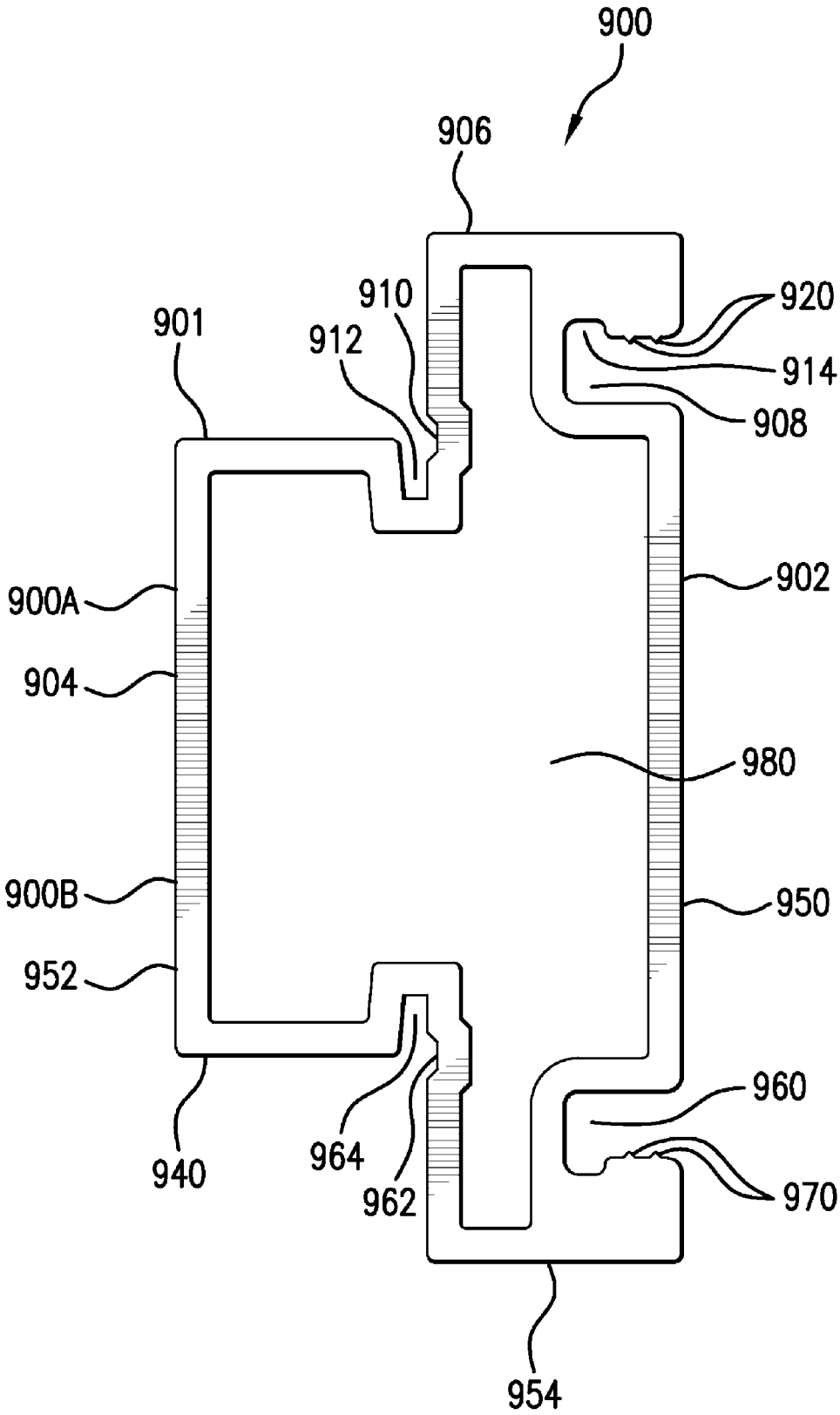
FIG. 22 is an end view of a center divider member in accordance with a further embodiment of the present invention.

Referring to FIG. 22, there is shown a center divider member 900 in accordance with a further embodiment of the present invention. Frame member 900 has shape that is basically the same as frame member 200 shown in FIGS. 6-8. However, there are some structural differences between frame member 900 and frame member 200. Frame member 900 extends longitudinally and comprises sections 900A and 900B which are mirror images of each other. Section 900A has shoulder 901 that extends in the lengthwise direction, exterior side 902, interior side 904, and lengthwise end portion 906. Section 900A has channels 908, 910 and 912 that serve the same purpose and function as channels 210, 222 and 220, respectively, of frame member 200. Channel 908 has portion 914 that extends deeper into lengthwise end 906. Channel 908 has substantially the same shape as channel 814 of frame member 800. The purpose of the shape of channel 908 is the same as the purpose of the shape of channel 814. Lengthwise end 906 includes nubs 920 that are located within channel 908 and serve the same purpose as nubs 830 of frame member 800. Channel 908 functions as a spline channel and is configured to receive spline apparatus 10 of the present invention. Section 900B is a mirror-image of section 900A. Section 900B comprises lengthwise extending shoulder 940, exterior side 950, interior side 952 and longitudinally or lengthwise extending end portion 954. Section 900B further includes channels 960, 962 and 964 which have the same shape and purpose as channels 908, 910 and 912, respectively, of section 900A. Thus, channel 960 functions as a spline channel and is configured to receive spline apparatus 10 of the present invention. End portion 954 includes nubs 970 that serve the same purpose as nubs 920 of section 900A. In one embodiment, frame member 900 has a hollow interior 980. In another embodiment, frame member 900 is of solid construction. Frame member 900 may be made from any of the materials discussed in the foregoing description. Conventional spline, in lieu of spline apparatus 10, can be used in spline channels 908 and 960.

In other embodiments, conventional spline may be used in channels 908 and 980 instead of spline apparatus 10. Such conventional spline includes hollow serrated spline, smooth hollow spline, "T" spline, poly-foam spline, flat spline and rigid spline.

Figure 23:
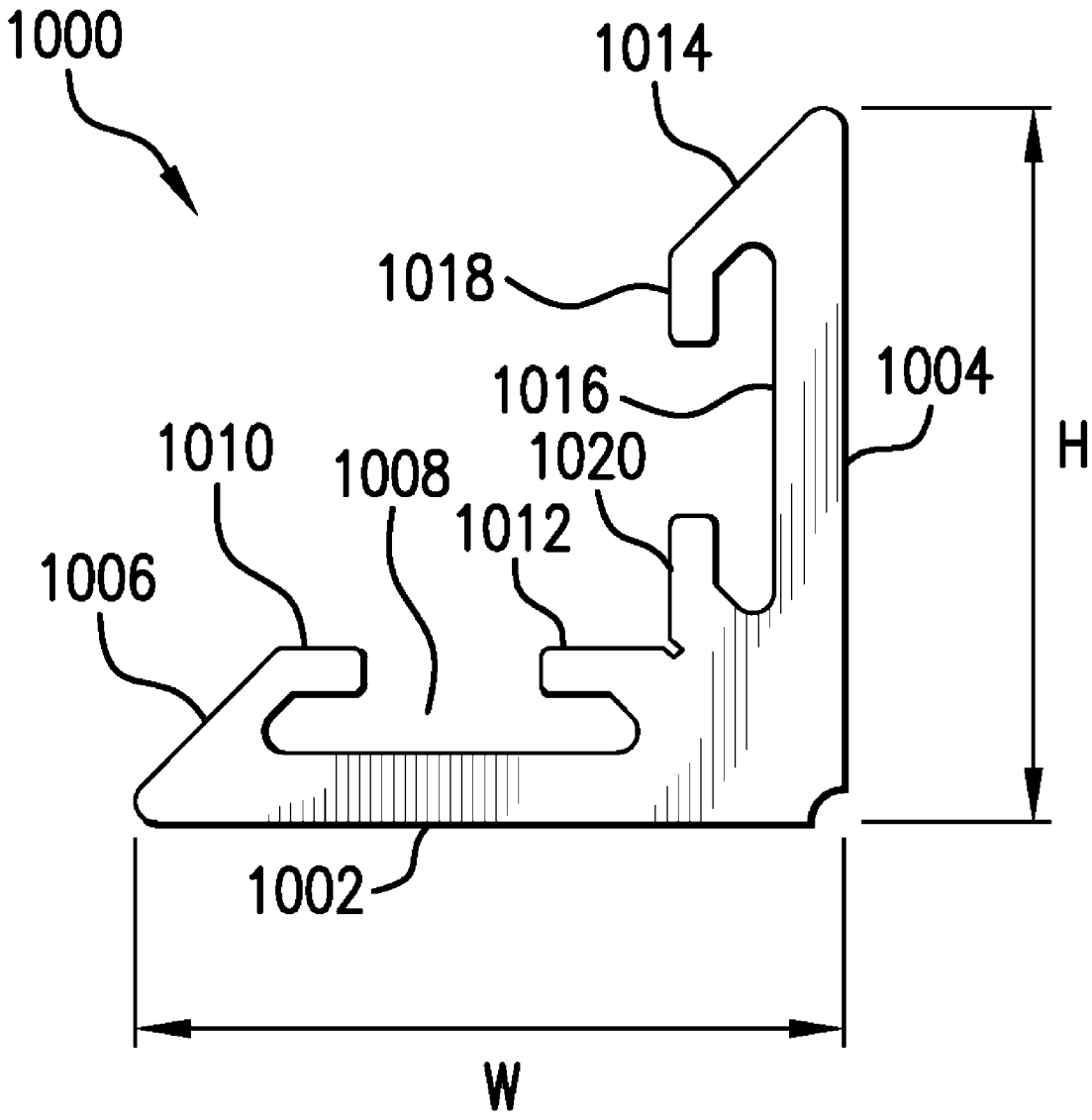
FIG. 23 is a side view, in elevation, of a corner support member in accordance with the present invention.
Figure 27:
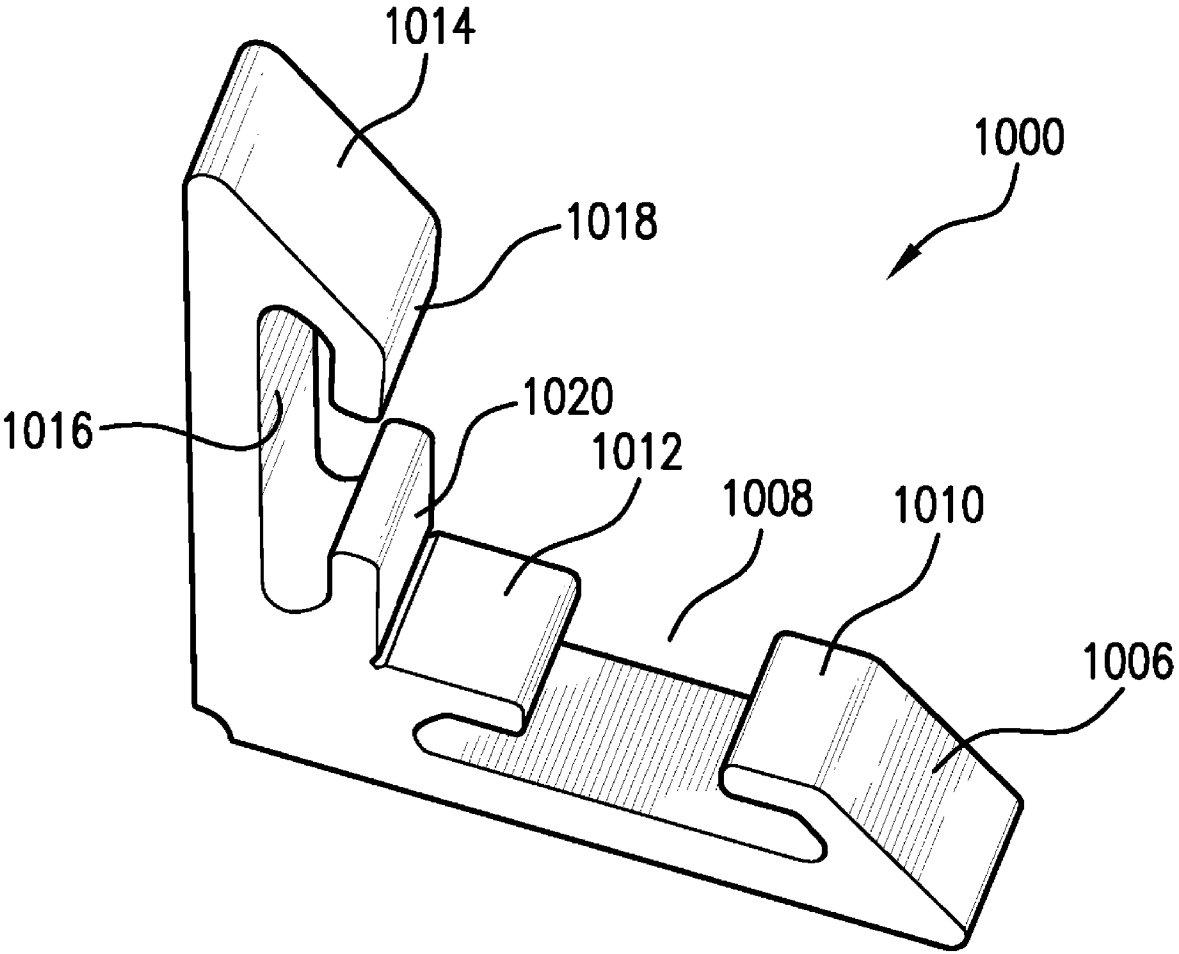
FIG. 27 is a perspective view the corner support member shown in FIG. 23.

Referring to FIGS. 23 and 27, there is shown corner support member 1000 in accordance with the present invention. Corner support member 1000 is configured to be embedded within a mitered corner of a screen frame assembly. This aspect of corner support member 1000 is discussed in detail in the ensuing description. Corner support member 1000 comprises section 1002 and section 1004. Sections 1002 and 1004 are orthogonally arranged. Section 1002 has beveled portion 1006, recess 1008 and overhang portions 1010 and 1012 that are on opposite sides of recess 1008. This particular structure of section 1002 keeps section 1002 embedded within its corresponding section of screen frame. Sections 1002 and 1004 are symmetrical in shape and structure. Thus, section 1004 has beveled portion 1014, recess 1016 and overhanging portions 1018 and 1020. Overhanging portions 1018 and 1020 are on opposite sides of recess 1016. This particular structure of section 1004 keeps section 1004 embedded within its corresponding section of screen frame.

Figure 24:
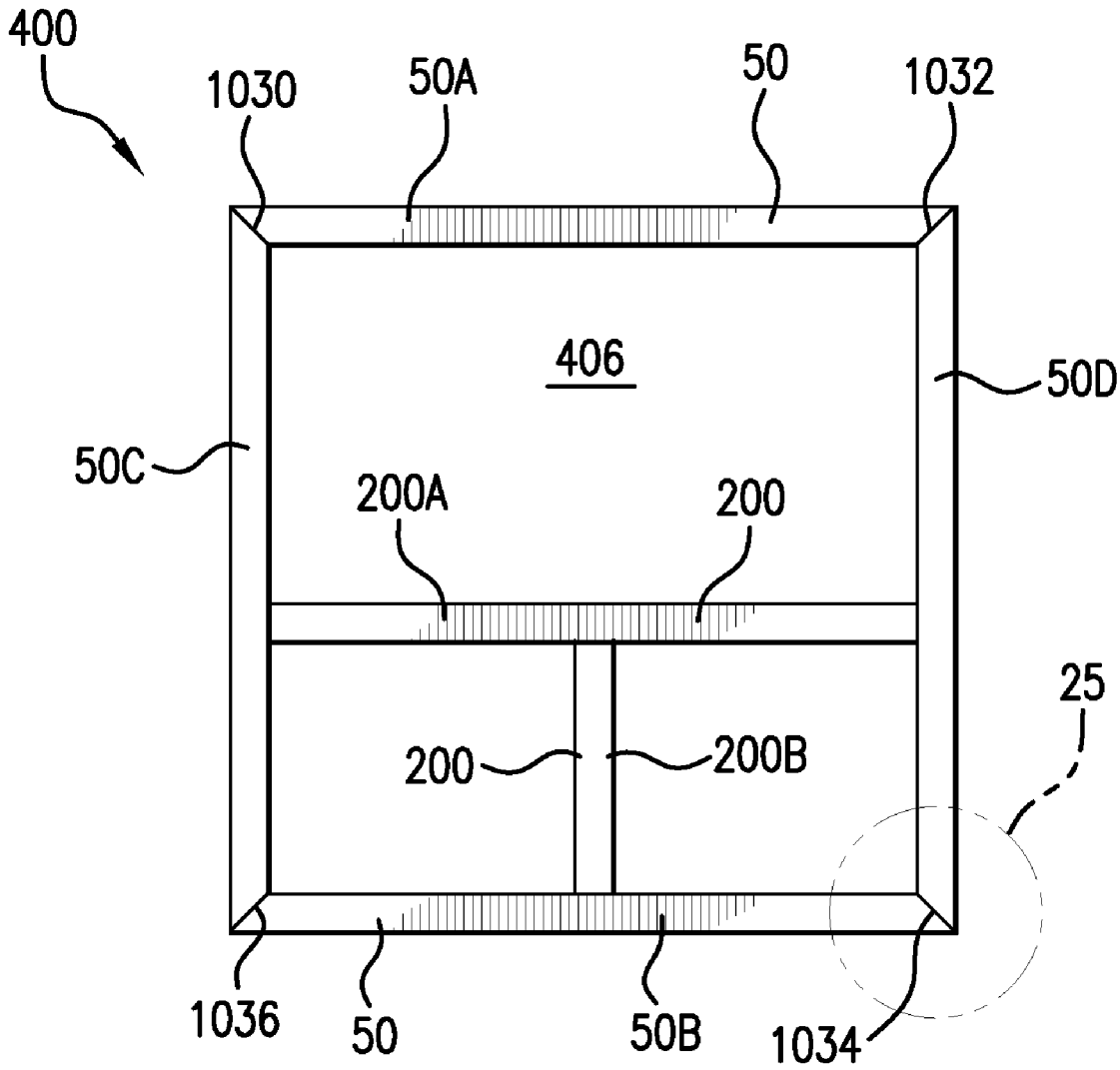
FIG. 24 shows the main frame assembly of FIG. 10 which incorporates the corner support member of FIG. 23 in each mitered corner of the main frame assembly.
Figure 25:
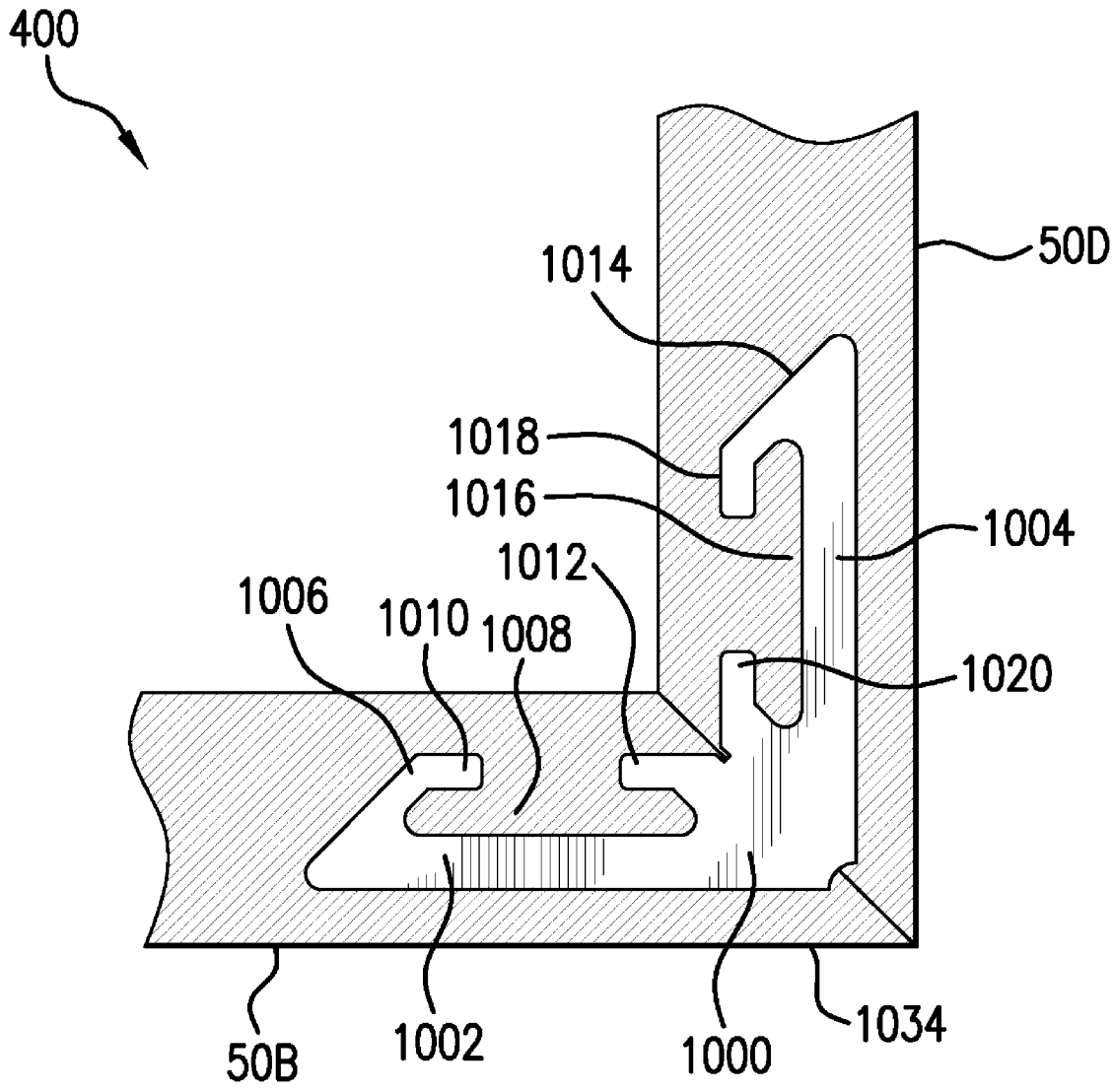
FIG. 25 is an enlarged view of a portion of the view shown in FIG. 24, the view being shown in cross-section.
Figure 26:
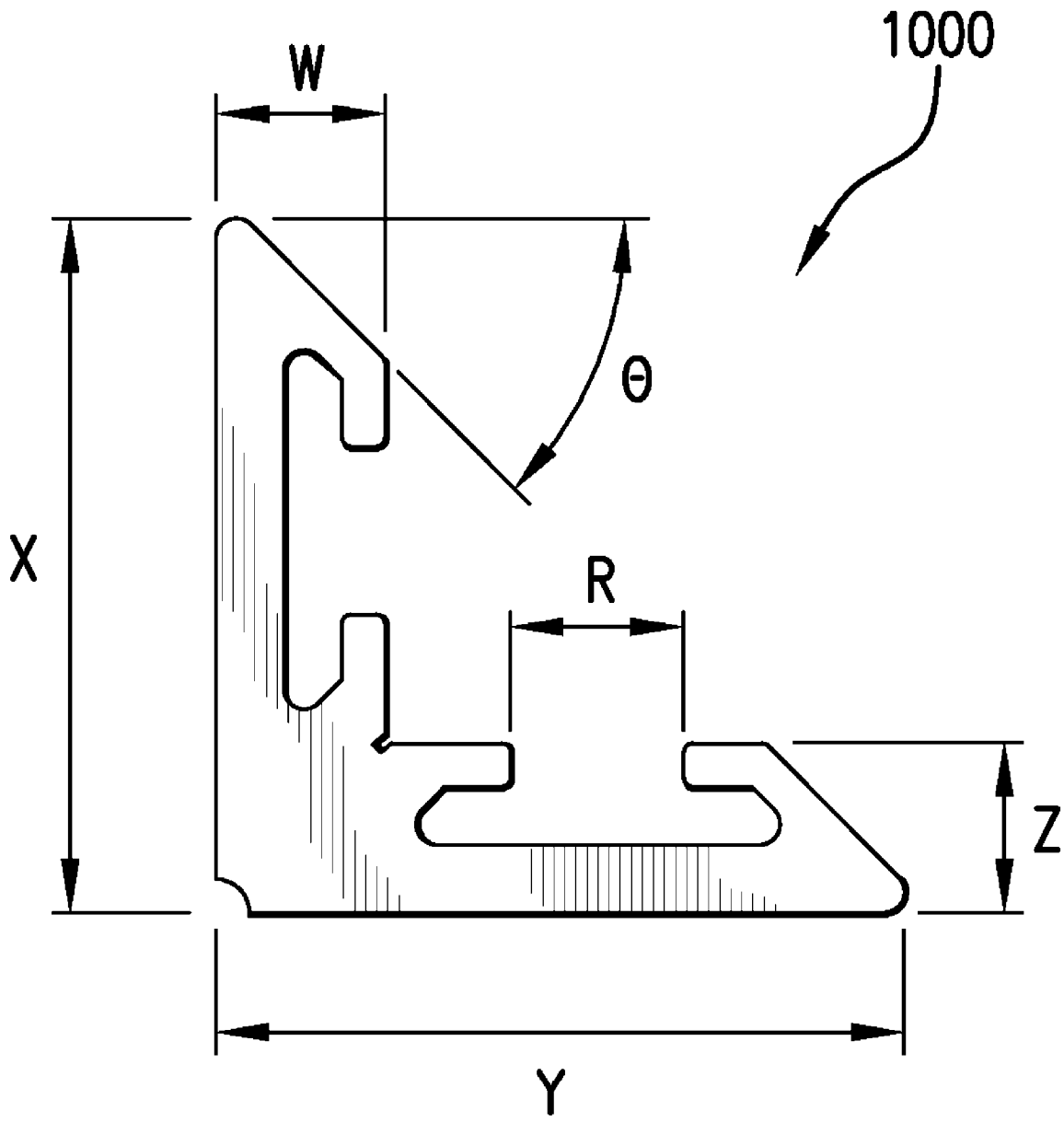
FIG. 26 is a side view, in elevation, of the corner support member of FIG. 23, showing dimensions of the corner support member in accordance with one embodiment of the present invention.

Referring to FIG. 24, there is shown screen frame 400, originally shown in FIG. 10, which incorporates corner support member 1000 in each mitered corner. Specifically, each mitered corner 1030, 1032, 1034 and 1036 of screen frame assembly 400 has a corresponding corner support member 1000 embedded therein. FIG. 25 is an enlarged view of corner section 1034 of screen frame assembly 400 which shows corner support member 1000 embedded in mitered corner 1034. Mitered corner 1034 is formed with frame sections 50B and 50D. Referring to FIG. 23, in one embodiment, corner support member 1000 has a width W of about four inches and a height H of about four inches. Corner support member 1000 has a depth of about one inch. FIG. 26 shows some exemplary dimensions of corner support member 1000. In this example, dimensions X and Y are 4.0 inches, dimension Z is 0.965 inch, dimension "R" is 1.0 inch, dimension W is 0.965 inch and angle θ is 45°. It is to be understood that these dimensions are just examples and can be varied. Corner support member 1000 can be fabricated from any one of a variety of suitable materials, e.g. aluminum, stainless steel, plastic, etc. If plastic is used to fabricate corner support member 1000, then it is preferred that an extrusion process be used.

It is to be understood that the sizes of the components of the invention shown in the drawings are exemplary and are not to be construed in a way that would limit the scope of the claimed invention. The views in the drawings are for illustrative purposes only. Thus, the present invention contemplates that all dimensions and sizes of spline apparatus 10, frame members 50, 200, 300, 800, and 900, "R" channel member 700, and corner support member 1000 may be varied to suit a particular need or application.

The foregoing description of the preferred embodiments of the invention has been presented for purposes of illustration and description only. It is neither intended to be exhaustive nor to limit the invention to the precise form disclosed; and obviously many modifications and variations are possible in light of the above teaching. Such modifications and variations that may be apparent to a person skilled in the art are intended to be included within the scope of this invention as defined by the accompanying claims.

What is claimed:

1. A longitudinally extending frame member comprising an exterior side, an interior side, a first lengthwise end section, a lengthwise shoulder section adjacent to said first lengthwise end section, and a second lengthwise end section that is opposite to said first lengthwise end section, said first lengthwise end section having a generally planar surface that is generally orthogonal to said exterior side, said lengthwise shoulder section having a generally planar shoulder surface that is substantially parallel to the generally planar surface of said first lengthwise end section, said longitudinally extending frame member further including a first longitudinally extending channel in said exterior side for receiving spline material, said first longitudinally extending channel having a predetermined channel depth that extends in a first direction and a substantially "U" shape, said first lengthwise end section further comprising a rear side that is opposite said exterior side and a second longitudinally extending channel in said rear side, said second longitudinally extending channel having a channel depth that extends in a second direction that is opposite said first direction, said longitudinally extending frame member further comprising a third longitudinally extending channel that is located between said longitudinally extending shoulder section and said first lengthwise end section and which is adjacent to said second longitudinally extending channel, said third longitudinally extending channel having a channel depth that extends in a third direction that is generally orthogonal to said first and second directions, said longitudinally extending frame member further comprising a fourth longitudinally extending channel in said second lengthwise end section, said fourth longitudinally extending channel having channel sidewalls that are angled outward and away from each other and a channel depth that extends in a fourth direction that is opposite said third direction and substantially orthogonal to said first and second directions, said second lengthwise end section further comprising generally planar surfaces that are located on either side of said fourth longitudinally extending channel and which are substantially parallel with said generally planar shoulder surface and said generally planar surface of said first lengthwise end section.

2. The longitudinally extending frame member according to claim 1 further comprising at least one longitudinally extending nub located within said first longitudinally extending channel for retaining spline material within said first longitudinally extending channel.

3. The longitudinally extending frame member according to claim 1 wherein said longitudinally extending frame member is fabricated from metal.

4. The longitudinally extending frame member according to claim 1 wherein said longitudinally extending frame member is fabricated from materials chosen from the group consisting of wood, plastic, resin, polycarbonate and composite materials.

* * * * *